US007422660B2

(12) United States Patent
Billgren et al.

(10) Patent No.: US 7,422,660 B2
(45) **Date of Patent: *Sep. 9, 2008**

(54) METHOD OF PRODUCING A NONWOVEN MATERIAL

(75) Inventors: Tomas Billgren, Kullavik (SE); Mats Soderberg, Sundsvall (SE); Mees Versteeg, Suamer (NL); Hein Lindstedt, Burgum (NL)

(73) Assignee: SCA Hygiene Products AB, Gothenburg (SE)

( * ) Notice: Subject to any disclaimer, the term of this patent is extended or adjusted under 35 U.S.C. 154(b) by 538 days.

This patent is subject to a terminal disclaimer.

(21) Appl. No.: 10/976,883

(22) Filed: Nov. 1, 2004

(65) Prior Publication Data

US 2005/0092417 A1 May 5, 2005

Related U.S. Application Data

(60) Provisional application No. 60/515,714, filed on Oct. 31, 2003.

(51) Int. Cl.
*D21F 1/32* (2006.01)

(52) U.S. Cl. ..... 162/199; 162/101; 162/103; 162/104; 162/124; 156/62.2; 264/280; 25/104; 25/167

(58) Field of Classification Search ..... 162/199, 162/101, 103, 104, 124, 115; 156/62.2; 28/104, 28/167, 105, 106, 115, 116; 264/280, 282
See application file for complete search history.

(56) References Cited

U.S. PATENT DOCUMENTS

| | | | | |
|---|---|---|---|---|
| 4,775,579 | A | 10/1988 | Hagy et al. | |
| 4,808,467 | A | 2/1989 | Suskind et al. | |
| 6,163,943 | A | 12/2000 | Johansson et al. | |
| 6,836,938 | B2 * | 1/2005 | Fleissner | 28/104 |
| 2002/0088099 | A1 | 7/2002 | Ahoniemi | |
| 2003/0045196 | A1 | 3/2003 | Kumehara | |

FOREIGN PATENT DOCUMENTS

| | | |
|---|---|---|
| EP | 0 308 320 | 3/1989 |
| EP | 0 315 507 | 5/1989 |
| EP | 1 215 325 | 6/2002 |
| EP | 1 288 362 | 3/2003 |
| WO | 99/22059 | 5/1999 |

* cited by examiner

*Primary Examiner*—Mark Halpern
(74) *Attorney, Agent, or Firm*—Young & Thompson

(57) ABSTRACT

Method of producing a nonwoven material, includes forming a web of continuous filaments on a forming member (12) and applying a wet- or foam formed fiber dispersion containing natural fibers and/or synthetic staple fibers on top of the continuous filaments. A fibrous web is thus formed containing continuous filaments and natural fibers and/or synthetic staple fibers, this web subsequently being hydroentangled to form a nonwoven material. Moisture is applied to the web of continuous filaments under a low pressure before laying the wet- or foam formed fiber dispersion on the web of continuous filaments, avoiding any substantial bonding between the filaments in the web.

13 Claims, 1 Drawing Sheet

METHOD OF PRODUCING A NONWOVEN MATERIAL

CROSS REFERENCE TO RELATED APPLICATION

This application claims the 35 USC 119(e) benefit of prior U.S. Provisional application Ser. No.: 60/515,714 filed on Oct. 31, 2003.

FIELD OF THE INVENTION

The present invention refers to a method of producing a nonwoven material, comprising forming a web of continuous filaments on a forming member and applying a wet- or foam formed fiber dispersion containing natural fibers and/or synthetic staple fibers on top of said continuous filaments, thus forming a fibrous web containing said continuous filaments and said natural fibers and/or synthetic staple fibers and subsequently hydroentangling the fibrous web to form a nonwoven material.

BACKGROUND OF THE INVENTION

Hydroentangling or spunlacing is a technique introduced during the 1970's, see e.g. CA patent no. 841 938. The method involves forming a fiber web which is either drylaid or wetlaid, after which the fibers are entangled by means of very fine water jets under high pressure. Several rows of water jets are directed against the fiber web which is supported by a movable wire. The entangled fiber web is then dried. The fibers that are used in the material can be synthetic or regenerated staple fibers, e.g. polyester, polyamide, polypropylene, rayon or the like, pulp fibers or mixtures of pulp fibers and staple fibers. Spunlace materials can be produced in high quality to a reasonable cost and have a high absorption capacity. They can e.g. be used as wiping material for household or industrial use, as disposable materials in medical care and for hygiene purposes etc.

Through e.g. EP-A-0 333 211 and EP-A-0 333 228 it is known to hydroentangle a fiber mixture in which one of the fiber components is meltblown fibers. The base material, i.e. the fibrous material which is exerted to hydroentangling, either consists of at least two preformed fibrous layers where one layer is composed of meltblown fibers or of a "coform material" where an essentially homogeneous mixture of meltblown fibers and other fibers is airlaid on a wire and after that is exerted to hydroentangling.

Through EP-A-0 308 320 it is known to bring together a web of continuous filaments with a wetlaid fibrous material containing pulp fibers and staple fibers and hydroentangle together the separately formed fibrous webs to a laminate. In such a material the fibers of the different fibrous webs will not be integrated with each other since the fibers already before the hydroentangling are bonded to each other and only have a very limited mobility.

EP-A-0 938 601 discloses a method of producing a nonwoven material by hydroentangling a fiber mixture containing continuous filaments, e.g. meltblown and/or spunbond fibers, and other fiber. The method is characterized by foam-forming a fibrous dispersion of natural fibers and/or synthetic staple fibers and hydroentangling together the foamed fiber dispersion with the continuous filaments for forming a composite material, in which the continuous filaments are well integrated with the rest of the fibers.

One problem arising from that different process units are used for laying the continuous filaments and the fibrous dispersion of natural fibers and/or synthetic staple fibers, wherein the handling and transfer of the formed web components between the different process components is very sensitive and critical in order not to disturb the formed web components. A web of unbonded continuous filaments is very fluffy and tears very easily if disturbed by for example air streams or water streams.

OBJECT AND SUMMARY OF THE INVENTION

The object of the present invention is to provide a method for producing a hydroentangled nonwoven material of a fibrous mixture of continuous filaments, e.g. in the form of meltblown and/or spunbond fibers and a wet- or foam formed fiber dispersion of natural fibers and/or synthetic staple fibers, in which the above problem occurring in the interface between the different process components is avoided or at least minimized. This has according to the invention been obtained by applying moisture under a low pressure to the web of continuous filaments before laying the wet- or foam formed fiber dispersion on the web of continuous filaments, avoiding any substantial bonding between the filaments in said web.

By this the web of continuous filaments is flattened out and a firm contact between the web and the forming wire, due to the surface tension of the liquid used for moistening the web, is established before it enters the zone, usually a headbox, in which the wet- or foam formed fiber dispersion is laid on top of the web of continuous filaments. The surface tension of the liquid used for moistening the web will cause an adhesive effect between the filament web and the forming wire.

According to one aspect of the invention the fibrous web is wet-formed or foam-formed.

In a further aspect of the invention a surfactant is added to the water used for moistening the web of continuous filaments.

According to one embodiment the fibrous web comprises between 20 and 85% by weight, preferably between 40 and 75% by weight natural fibers. The natural fibers as in one embodiment pulp fibers.

The fibrous web may further contain between 5 and 50% by weight, preferably between 5 and 20% by weight synthetic or regenerated staple fibers. In one aspect of the invention at least a major part, which means at least 50, preferably at least 70, more preferably at least 90 and most preferably at least 100% by weight of said synthetic or regenerated staple fibers have a fiber length between 3 and 7 mm.

The content of continuous filaments in the web is suitably between 0.5 and 50% by weight, preferably between 15 and 30% by weight. The continuous filaments are usually in the form of spunlaid or meltblown filaments.

Further features of the present invention are disclosed in the description below.

BRIEF DESCRIPTION OF THE DRAWINGS

The invention will below be closer described with reference to an embodiment shown in the accompanying drawings.

DETAILED DESCRIPTION OF THE INVENTION

Figure 1:
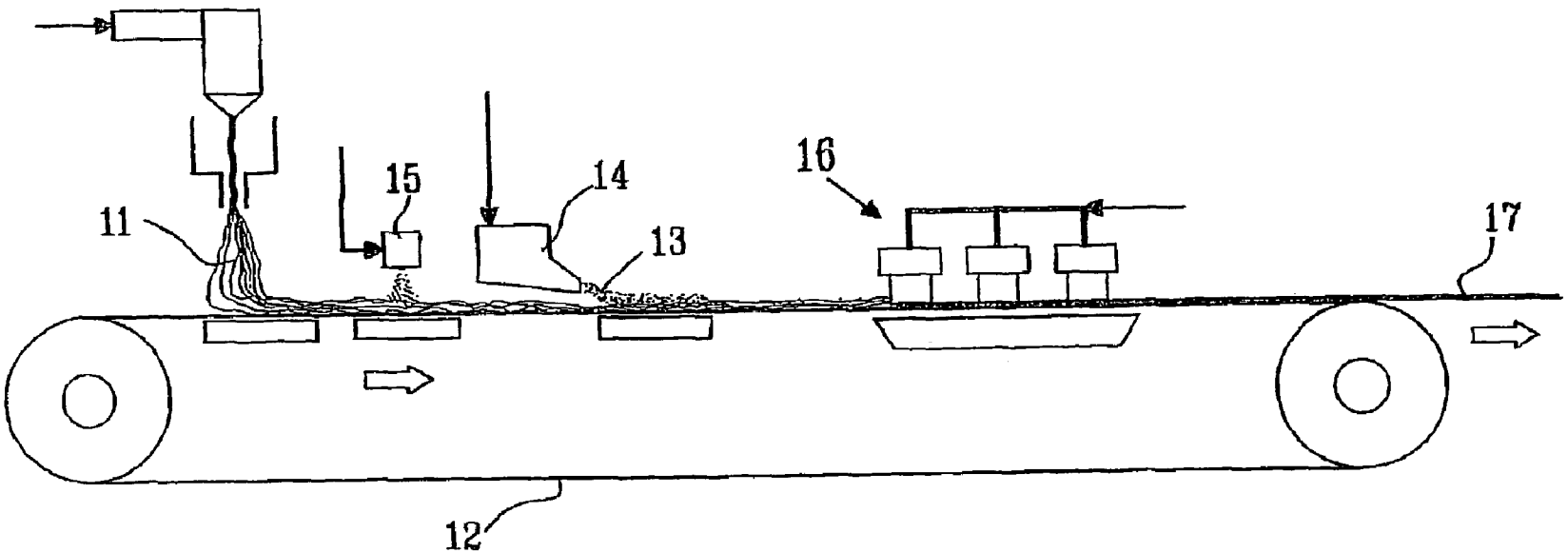
FIG. 1 shows schematically an embodiment of a process for producing a hydroentangled nonwoven material according to the invention.

The hydroentangled composite material according to the invention comprises a mixture of continuous filaments and natural fibers and/or synthetic staple fibers. These different types of fibers are defined as follows.

Continuous Filaments

The continuous filaments are fibers that in proportion to their diameter are very long, in principle endless. They can be produced by extruding a molten thermoplastic polymer through fine nozzles, whereafter the polymer will be cooled and drawn, preferably by the action of an air flow blown at and along the polymer streams, and solidified into strands that can be treated by drawing, stretching or crimping. Chemicals for additional functions can be added to the surface.

Filaments can also be regenerated fibers produced by chemical reaction of a solution of fiber-forming reactants entering a reagent medium, for example by spinning of regenerated cellulose fibers from a cellulose xanthate solution into sulphuric acid. Examples of regenerated cellulose fibers are rayon, viscose or lyocell fibers.

Continuous filaments may be in the form of spunlaid filaments or meltblown filaments. Spunlaid filaments are produced by extruding a molten polymer, cool and stretch to an appropriate diameter. The fiber diameter is usually above 10 μm, e.g. between 10 and 100 μm. Production of spunlaid filaments is e.g. described in U.S. Pat. Nos. 4,813,864 and 5,545,371.

Meltblown filaments are formed by means of a meltblown equipment 10, for example of the kind shown in the U.S. Pat. Nos. 3,849,241 or 4,048,364. The method shortly involves that a molten polymer is extruded through a nozzle in very fine streams and converging air streams are directed towards the polymer streams so that they are drawn out into continuous filaments with a very small diameter. The filaments can be microfibers or macrofibers depending on their dimension. Microfibers have a diameter of up to 20 μm, but usually are in the interval between 2 and 12 μm in diameter. Macrofibers have a diameter of over 20 μm, e.g. between 20 and 100 μm.

All thermoplastic polymers can in principle be used for producing spunlaid and meltblown filaments. Examples of useful polymers are polyolefins, such as polyethylene and polypropylene, polyamides, polyesters and polylactides. Copolymers of these polymers may of course also be used.

Tow is another type of filaments, which normally are the starting material in the production of staple fibers, but which also is sold and used as a product of its own. In the same way as in the production of with spunlaid fibers, tow is produced from fine polymer streams that are drawn out and stretched, but instead of being laid down on a moving surface to form a web, they are kept in a bundle to finalize drawing and stretching. When staple fibers are produced, this bundle of filaments is then treated with spin finish chemicals, are often crimped and then fed into a cutting stage where a wheel with knives will cut the filaments into distinct fiber lengths that are packed into bales to be shipped amd used as staple fibers. When tow is produced, the filament bundles are packed, with or without spin finish chemicals, into bales or boxes.

The continuous filaments will in the following be described as spunlaid fibers, but it is understood that also other types of continuous filaments, e.g. meltblown fibers, can be used.

Natural Fibers

The natural fibers are usually cellulose fibers, such as pulp fibers or fibers from grass or straw. Pulp fibers are the most commonly used natural fibers and are used in the material for their tendency to absorb water and for their tendency to create a coherent sheet. Both softwood fibers and hardwood fibers are suitable, and also recycled fibers can be used, as well as blends of these types of fibers. The fiber lengths will vary from around 2-3 mm for softwood fibers and around 1-1.5 mm for hardwood fibers, and even shorter for recycled fibers.

Staple Fibers

The staple fibers used can be produced from the same substances and by the same processes as the filaments discussed above. They may either be synthetic fibers or regenerated cellulose fibers, such as rayon, viscose or lyocell. The cutting of the fiber bundles is normally done to result in a single cut length, which can be altered by varying the distances between the knives of the cutting wheel. The fiber lengths of conventional wetlaid hydroentangled nonwovens are usually in the interval 12-18 mm. However according to the present invention also shorter fiber lengths, from about 2-3 mm, can be used.

The Process

According to the embodiment shown in FIG. 1 continuous filaments 11 in the form of spunlaid fibers are produced by extruding a molten polymer, cool and stretch to an appropriate diameter. The fiber diameter is usually above 10 μm, e.g. between 10 and 100 μm.

In an alternative embodiment meltblown fibers are formed by means of a meltblown equipment. The meltblown technique shortly involves that a molten polymer is extruded through a nozzle in very fine streams and converging air streams are directed towards the polymer streams so that they are drawn out into continuous filaments with a very small diameter.

The fibers can be microfibers or macrofibers depending on their dimension. Microfibers have a diameter of up to 20 μm, but usually are in the interval between 2 and 12 μm in diameter. Macrofibers have a diameter of over 20 μm, e.g. between 20 and 100 μm.

All thermoplastic polymers can in principle be used for producing spunlaid and meltblown fibers. Examples of useful polymers are polyolefins, such as polyethylene and polypropylene, polyamides, polyesters and polylactides. Copolymers of these polymers may of course also be used.

The continuous filaments will in the following be described as spunlaid fibers, but it is understood that also other types of continuous filaments, e.g. meltblown fibers, can be used.

According to the embodiment shown in FIG. 1 the spunlaid fibers 11 are laid down directly on a forming wire 12 where they are allowed to form a relatively loose, open web structure in which the fibers are relatively free from each other. This is achieved either by making the distance between the spunlaying nozzle and the wire relatively large, so that the filaments are allowed to cool down before they land on the wire 12, at which their stickiness is reduced. The basis weight of the formed spunlaid layer should be between 2 and 50 g/m$^2$ and the bulk between 5 and 15 cm$^3$/g.

An aqueous or a foamed fibrous dispersion 13 from a headbox 14 is laid on top of the spunlaid filaments. In wet laying technique the fibers are dispersed in water, with optional additives, and the fiber dispersion is dewatered on a forming fabric to form a wet laid fibrous web. In the foam forming technique a fibrous web is formed from a dispersion of fibers in a foamed liquid containing water and a tenside. The foam forming technique is described in for example GB 1,329,409, U.S. Pat. No. 4,443,297, WO 96/02701 and EP-A-0 938 601. A foam-formed fibrous web has a very uniform fiber formation. For a more detailed description of the foam forming technique reference is made to the above mentioned documents.

The spunlaid filaments and the fiber dispersion of natural fibers and/or synthetic staple fibers may be formed on the same or on different wires. The web of spunlaid filaments laid on the wire 12 has a rather low basis weight and is substantially unbonded, which means that the web is very weak and has to be handled and transferred to the next forming station, the headbox 14, very gently.

In order to provide a certain consolidation of the web of spunlaid filaments and avoid that the web is damaged on its way to the headbox, it is according to the invention suggested that moisture is applied to the web by a spray bar 15 or gentle shower before laying the wet- or foam formed fiber dispersion on the web of the continuous filaments. By this the web of continuous filaments is flattened out and a firm contact between the web and the forming wire is established before it enters the headbox zone, in which the wet- or foam formed fiber dispersion is laid on top of the web of continuous filaments. The wettening of the filaments takes place at a very low pressure so that no substantial bonding or sideways displacement of the fibers take place. The surface tension of the water will adhere the filaments to the wire so the formation will not distort while entering the headbox. The term "no substantial bonding" as used herein means that there will be no substantial bonding effect in addition to what is caused by the surface tension of the liquid used. In some cases, when hydrophobic polymers are used for forming the spunlaid filaments, a tenside may be added in the spraybar 23 to wet the fibers.

A further advantage of having the spunlaid filaments wetted before applying the wet- or foam formed fiber dispersion thereon is that an improved penetration of the fibers contained in the fiber dispersion is obtained, resulting in a better integration between the spunlaid filaments and the fibers from the fiber dispersion. A small amount of a tenside, between 0.001 and 0.1% by weight, may be added to the water used for moistening the spunlaid filaments in order to increase the wettability of the filaments.

If more water is used than what is taken up by the filament web, the excess of water is drained through the wire to a suction box.

According to one embodiment a relatively coarse forming wire 12 is used. This will aid in "binding" or "holding" the web of spunlaid filaments to the wire by bending up and down and conform to the topography of the wire and thus prevent it from moving when the wet- or foam formed fiber dispersion flushes down from the headbox 12 on top of the spunlaid web.

Fibers of many different kinds and in different mixing proportions can be used for making the wet laid or foam formed fibrous web. Thus there can be used pulp fibers or mixtures of pulp fibers and synthetic staple fibers, e.g. polyester, polypropylene, rayon, lyocell etc. Varying fiber lengths can be used. However, according to the invention, it is of advantage to use relatively short staple fibers, below 10 mm, preferably in the interval 2 to 8 mm and more preferably 3 to 7 mm. This is for some applications an advantage because the short fibers will more easily mix and integrate with the spunlaid filaments than longer fibers. There will also be more fiber ends sticking out form the material, which increases softness and textile feeling of the material. For short staple fibers both wet laying and foam forming techniques may be used.

In foam forming technique longer fibers can be used than what is possible with wetlaying technique. Long fibers, about 18-30 mm, may in another aspect of the invention be an advantage, since they increase the strength of the hydroentangled material in dry as well as in wet condition.

As a substitute for pulp fibers other natural fibers with a short fiber length may be used, e.g. esparto grass, phalaris arundinacea and straw from crop seed.

It is preferred that the fibrous web comprises as least between 20 and 85% by weight, preferably between 40 and 75% by weight natural fibers, for example pulp fibers.

It is further preferred that the fibrous web contains between 10 and 50% by weight, preferably between 15 and 30% by weight, continuous filaments, for example in the form of spunlaid or meltblown filaments.

The fiber dispersion laid on top of the spunlaid filaments is dewatered by suction boxes (not shown) arranged under the wire 12. The wet- and foam formation benefits from an increased openness in the forming wire 12. The short pulp fibers and synthetic staple fibers are formed on top of the spunlaid web, which provides the necessary closeness and acts like an extra sieve for the formation of the short fibers. Also from this point of view the choice of forming wire 12 may be done from the coarse end of the available spectrum.

The thus formed fibrous web comprising spunlaid filaments and other fibers is quite stable by the presence of the pulp fibers and/or staple fibers that will interlock the spunlaid fibers, which in their turn, reinforce the structure. The web is then hydroentangled in an entangling station 16 including several rows of nozzles, from which very fine water jets under high pressure are directed against the fibrous web. For a further description of the hydroentangling technique or, as it is also called, the spunlace technique, reference is made to e.g. CA patent 841,938. Alternatively, the fibrous web can before hydroentangling be transferred to a special entangling wire, which optionally may be patterned in order to form a patterned nonwoven fabric. In this case the web can also prior to the transfer be hydroentangled by a first entangling station with one or more rows of nozzles in order to consolidate the web. However such a preentangling will nest the material to the wire, which will require a successively increasing draw in the transfer to the entangling wire. In an alternative embodiment the fibrous web is formed and hydroentangled on the same wire 12.

The hydroentangling may in a known manner from both sides of the fibrous material (not shown) at which a more homogeneous equilateral material is obtained.

The forming wire 12 and/or the entangling wire 16 may of course be substituted for another appropriate forming and entangling member respectively, such as an apertured belt, an apertured drum etc.

It is an important aspect of the invention that the spunlaid web is secured to the forming wire which is done by moistening or pre-wetting the spunlaid web. The formation of the whole composite material is then completed on the same wire, which can be relatively coarse.

After the hydroentangling the material 17 is dried and wound up. The material is then converted in a known manner to a suitable format and is packed.

Since it is preferred to have closed loops of process water as far as this is possible, the water that has been dewatered at the forming, moistening and hydroentangling steps is preferably recirculated.

The invention claimed is:

1. In a method of producing a nonwoven material, comprising forming a web of continuous filaments on a forming member (12) and applying a wet- or foam formed fiber dispersion containing natural fibers and/or synthetic staple fibers on top of said continuous filaments, thus forming a fibrous web containing said continuous filaments and said natural fibers and/or synthetic staple fibers and subsequently hydroentangling the fibrous web to form a nonwoven material, the improvement which comprises applying moisture under a low pressure to the web of continuous filaments before laying the wet- or foam formed fiber dispersion on the web of continuous filaments, avoiding any substantial bonding between the filaments in said web, the surface tension of the moisture causing an adhesive effect between the filament web and said forming member (12).

2. The method as claimed in claim 1, wherein a tenside is added to the water used for moistening the web of continuous filaments.

3. The method as claimed in claim 1, wherein the fibrous web comprises between 20 and 85% by weight natural fibers.

4. The method as claimed in claim 3, wherein the natural fibers are pulp fibers.

5. The method as claimed in claim 1, wherein the fibrous web contains between 5 and 50% by weight synthetic or regenerated staple fibers.

6. The method as claimed in claim 5, wherein at least a major part of the synthetic or regenerated staple fibers have a fiber length between 3 and 7 mm.

7. The method as claimed in claim 6, wherein at least 70% by weight of said synthetic or regenerated staple fibers have a fiber length between 3 and 7 mm.

8. The method as claimed in claim 6, wherein at least 90% by weight of said synthetic or regenerated staple fibers have a fiber length between 3 and 7 mm.

9. The method as claimed in claim 6, wherein at least 100% by weight of said synthetic or regenerated staple fibers have a fiber length between 3 and 7 mm.

10. The method as claimed in claim 1, wherein the fibrous web contains between 0.5 and 50% by weight continuous filaments.

11. The method as claimed in claim 10, wherein the continuous filaments are in the form of spunlaid or meltblown filaments.

12. The method as claimed in claim 1, wherein the fibrous web comprises between 40 and 75% by weight natural fibers.

13. The method as claimed in claim 1, wherein the fibrous web contains between 5 and 20% by weight synthetic or regenerated staple fibers.

* * * * *